United States Patent [19]

Griffith et al.

[11] 4,142,327

[45] Mar. 6, 1979

[54] TRACK MECHANISM ASSEMBLY FOR A LIGHT RAIL VEHICLE

[75] Inventors: Thomas Griffith, West Chester; Richard Campbell, Newtown Square, both of Pa.

[73] Assignee: The Boeing Company, Seattle, Wash.

[21] Appl. No.: 821,104

[22] Filed: Aug. 2, 1977

[51] Int. Cl.[2] ..... E05D 15/10

[52] U.S. Cl. ..... 49/215; 49/216; 49/223; 49/360

[58] Field of Search ..... 49/212–215, 49/216, 218, 209, 211, 225, 360, 122, 223

[56] References Cited

U.S. PATENT DOCUMENTS

| | | | |
|---|---|---|---|
| 2,807,836 | 10/1957 | Knowles | 49/212 |

FOREIGN PATENT DOCUMENTS

| | | | |
|---|---|---|---|
| 2030042 | 2/1971 | Fed. Rep. of Germany | 49/214 |
| 2216898 | 11/1972 | Fed. Rep. of Germany | 49/225 |
| 2322692 | 5/1973 | Fed. Rep. of Germany | 99/218 |
| 939546 | 10/1963 | United Kingdom | 49/212 |

*Primary Examiner*—Kenneth Downey

*Attorney, Agent, or Firm*—Felix J. D'Ambrosio; Edwin E. Greigg; Jack D. Puffer

[57] ABSTRACT

What follows is a description of a three track mechanism assembly for a vehicle door, and in particular for a light rail vehicle door. Each track mechanism includes a guide rail for guiding the door in its opening and closing movement relative to the vehicle body. Two of the track mechanisms include actuators for producing the opening and closing movement of the door. One of these actuators produces the desired longitudinal displacement of the door relative to the vehicle body, while the other actuator produces the desired transverse displacement of the door relative to the vehicle body. In addition, an extraction device can be included with the track mechanism having the actuator producing the desired longitudinal displacement for assisting the other actuator in producing the desired transverse displacement of the door relative to the vehicle body. The same two track mechanisms which include the noted actuators also serve to transfer the door weight to the vehicle body, each transferring a part of the door weight.

39 Claims, 11 Drawing Figures

FIG.1
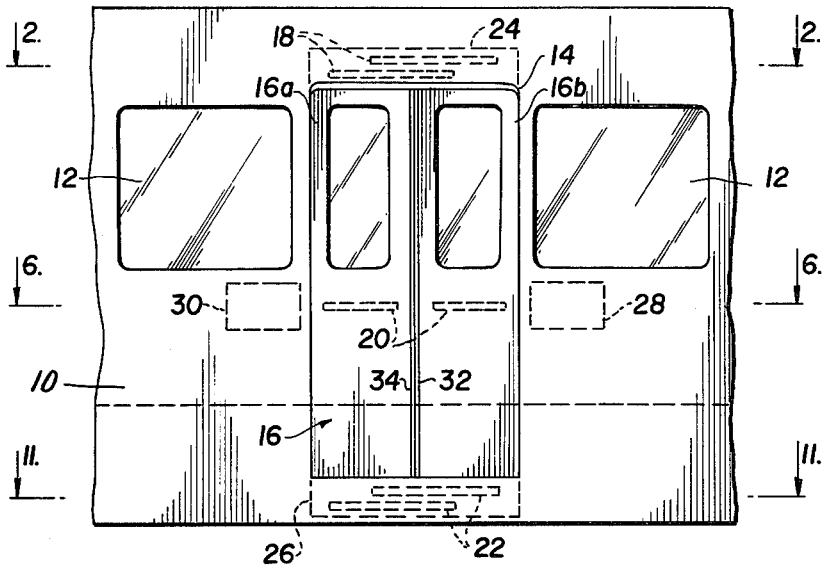
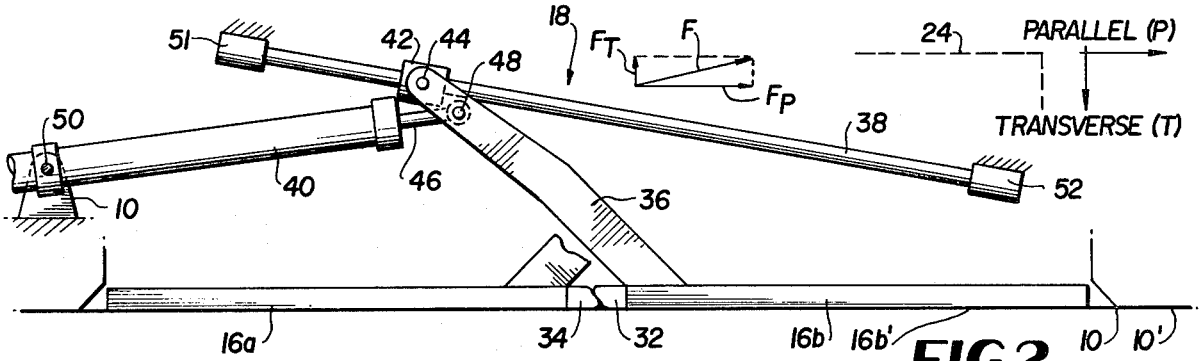
FIG.2
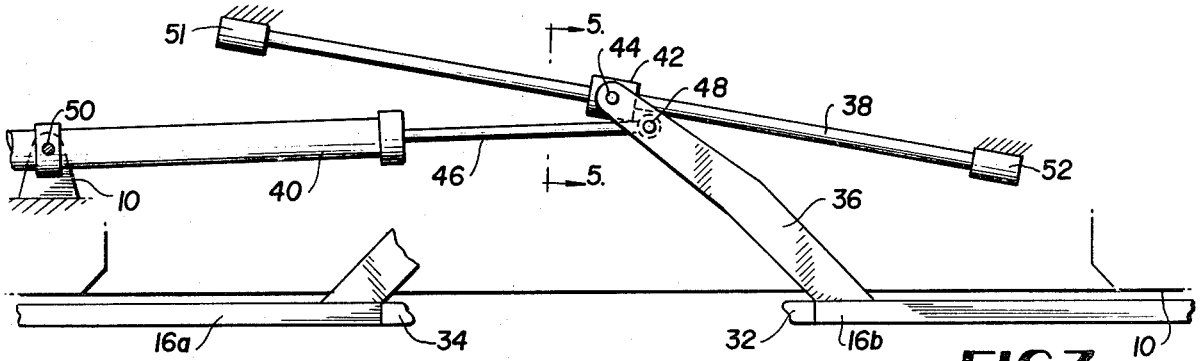
FIG.3
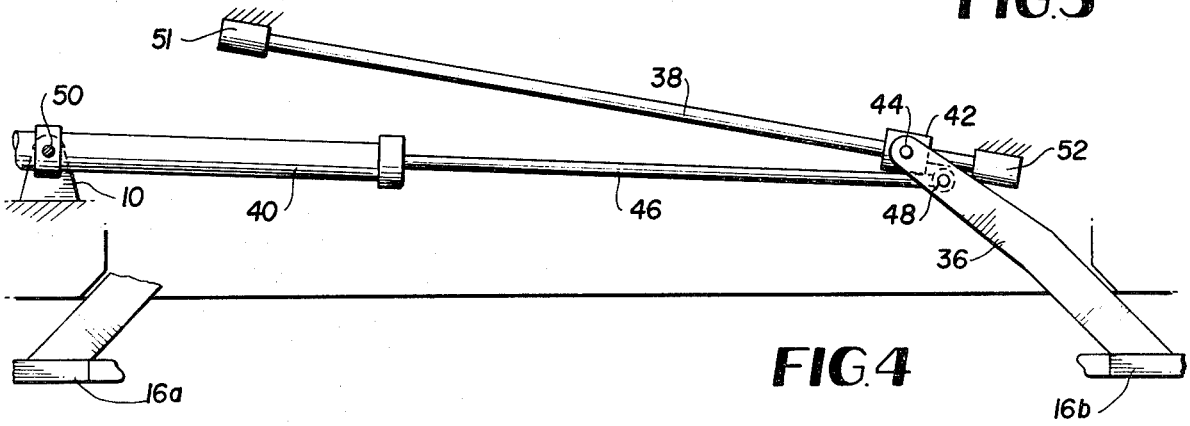
FIG.4

FIG.6
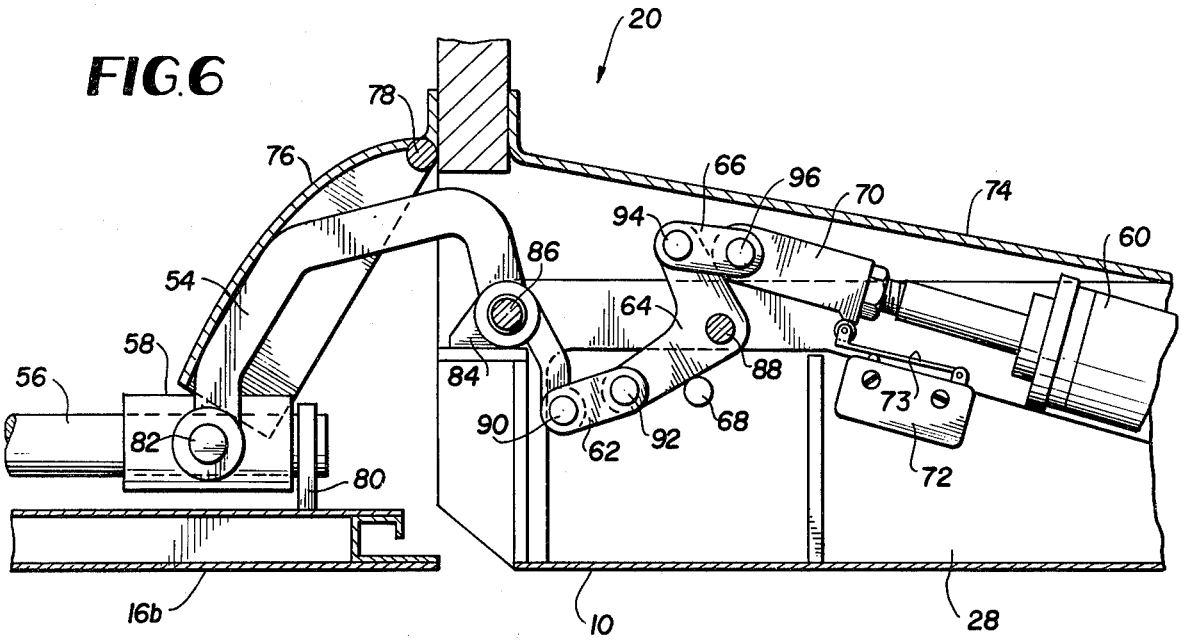
FIG.7
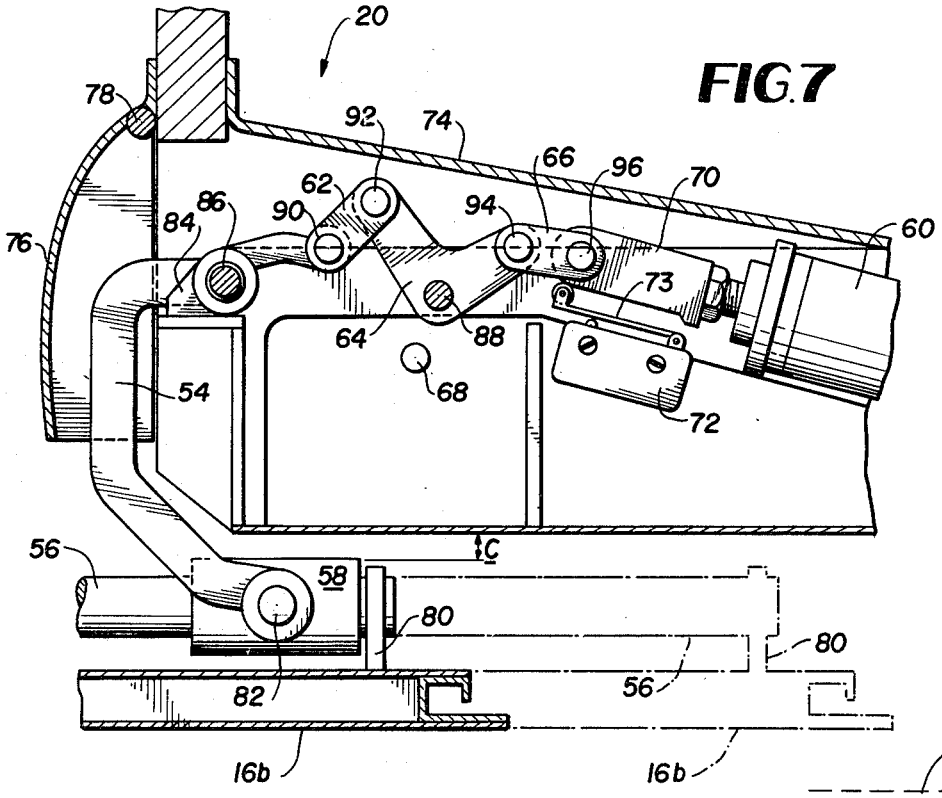
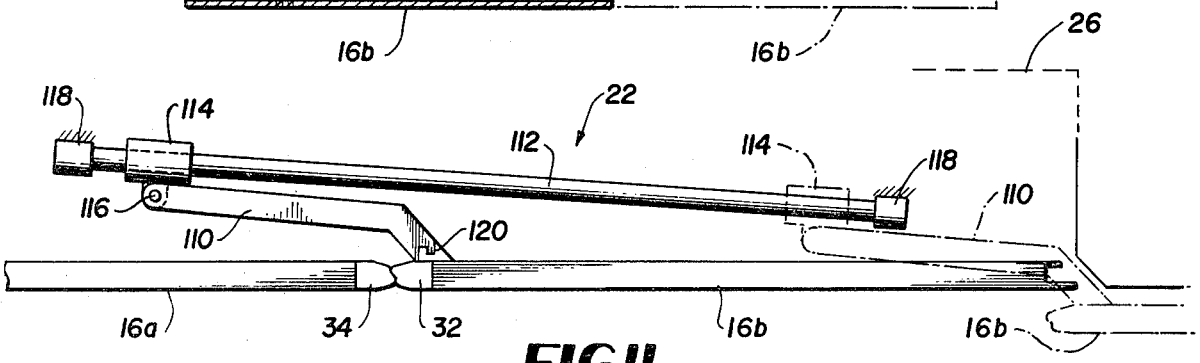
FIG.11

TRACK MECHANISM ASSEMBLY FOR A LIGHT RAIL VEHICLE

BACKGROUND OF THE INVENTION

A. Field of the Invention

This invention relates to track mechanisms for doors, and in particular to an assembly of three track mechanisms for a light rail vehicle door.

B. Discussion of the Prior Art

The following U.S. Pat. Nos. bearing on the subject matter of this invention are known: 3,453,778; 3,462,881; 3,826,042; and 3,844,062.

These patents disclose essentially two track mechanism assemblies in which the door weight is carried, for the most part, by one of the track mechanisms. Broadly, the track mechanisms produce a so-called "compound movement" of the doors, i.e., a movement which is both parallel and transverse to the vehicle wall. This is a desirable feature of these track mechanisms. However, the means for achieving this feature are relatively complex with a high part count. A more direct path of actuation for achieving this feature would be desirable. It would also be desirable to better transfer the door weight back to the vehicle body, and to accomplish both of these desideratum without increasing the part count.

OBJECTS AND SUMMARY OF THE INVENTION

From its broadest to its most specific aspects, the invention herein disclosed and claimed achieves a number of specific objects, among these being:

1. a more direct path of actuation of the compound movement of the vehicle doors;
2. a better distribution and transfer of the door weight to the vehicle body;
3. a reduced parts count per track mechanism;
4. a better utilization of the forces producing the movement of the doors which is substantially transverse to the vehicle body;
5. a better utilization of the forces producing the movement of the doors which is substantially parallel to the vehicle body;
6. an environmentally protected track mechanism assembly;
7. a low maintenance track mechanism assembly; and
8. a track mechanism assembly which maximizes the utilization of available vehicle space.

The invention contemplates these exemplary objects and accomplishes them fully in all of its aspects. To this end the invention proposes the use of three track mechanisms located adjacent the upper, middle and lower portions of each door opening. Two of the track mechanisms transfer the door weight to the vehicle body, while all three track mechanisms guide the door during its compound movement. Preferably each of the two track mechanisms which transfer the door weight to the vehicle body includes actuating means which very nearly apply their actuating forces directly to the door. In addition, and according to one embodiment of the invention, one of the actuating means exerts an actuation intended to effect the parallel or longitudinal movement of the door while the other actuating means exerts an actuation intended to primarily effect the transverse movement of the door. According to a variant of the invention, the actuating means exerting an actuation intended to effect the parallel or longitudinal movement of the door also exerts an actuation intended to assist in effecting the transverse movement of the door.

In describing the invention in more detail, reference will be made to certain preferred embodiments, it being understood that this reference is by way of example and is not intended to be restrictive in relation to the scope of the invention.

BRIEF DESCRIPTION OF THE DRAWINGS

All of the figures are illustrated in schematic form for a better understanding of the invention.

FIG. 1 is a schematic partial elevation view of a vehicle body and door illustrating the approximate location of the three track mechanism system of the present invention;

FIG. 2 is a schematic view looking in the direction 2—2 of FIG. 1, illustrating the essential details of the upper track mechanism of the present invention with the door closed;

FIGS. 3 and 4 are schematic views similar to FIG. 2, illustrating the initial open position (unplugged) and fully open position of the door and upper track mechanism, respectively;

FIG. 6 is a schematic view looking in the direction 6—6 of FIG. 1, illustrating the essential details of the middle or waist track mechanism of the present invention with the door closed;

FIG. 7 is a schematic view similar to FIG. 6, illustrating the initial open (unplugged) and fully open position (in dashed lines) of the door and middle track mechanism;

FIG. 11 is a schematic view looking in the direction 11—11 of FIG. 1, illustrating the essential details of the lower track mechanism of the present invention with the door closed, and fully open (dashed lines).

GENERAL DISCUSSION

Figure 5:
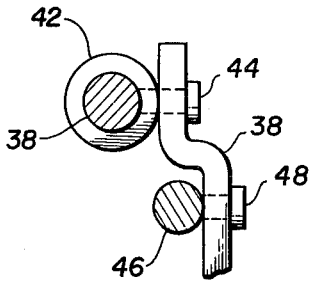
FIG. 5 is a section view taken along the line 5—5 of FIG. 3.

A light rail vehicle is a generic designation for a class of high speed mass transit vehicles being proposed or already in use in many of the larger urban areas of the industrialized world. They are used most frequently as track guided surface or subway vehicles. Generally these vehicles are designed to permit low operating costs and maximum space utilization. In addition, all dynamic systems should have a high degree of reliability with a low maintenance factor.

This invention is concerned with the mechanical structures which control the opening and closing of the vehicle doors. The systems which control the mechanical structures are not disclosed since they do not form a part of this invention. The skilled artisan will appreciate the fact that the utilization of the control systems in effecting the necessary actuation of the mechanical structures is conventional.

The vehicle may typically have three doors, one at the right front part of the vehicle adjacent to the operator's station, and one each at the center left and center right of the vehicle. Each door fits flush within an opening provided in the vehicle body. Such a configuration is known in the art as a "plugged" configuration. Basically this means that the outer surface of the door and the outer surface of the vehicle body, at least that portion adjacent to the door, lie in the same straight or curved plane. Each door may be a single door or it may comprise a pair of door leaves. In this latter case, each door leaf is provided with the three track mechanism assembly.

The track mechanism assembly comprises therefore three track mechanisms for each door or door leaf. Hereinafter these track mechanisms will be designated as the upper track mechanism (first track mechanism), the middle or waist track mechanism (second track mechanism) and the lower track mechanism (third track mechanism). Also, those individual components of the track mechanism which are common to each track mechanism carry the designation of that track mechanism, i.e., first, second or third.

Here as in the noted prior art, the track mechanism assembly produces a compound movement of the door or door leaves. The transverse movement is never truly transverse, since the primary component controlling this movement itself experiences a pivotal movement. It is convenient, however, and consistent with the prior art, to refer to this movement as transverse.

Finally, before proceeding to a detailed discussion of the preferred exemplary embodiments, it should be noted that this invention is not limited to a plug door configuration, nor is it limited to use with a vehicle. It could be used with a stationary structure. The relative simplicity of the assembly makes it attractive in building structures, vessels, aircraft, to mention just a few applications.

DETAILED DESCRIPTION

In FIG. 1 there is shown a portion of a light rail vehicle car body (vehicle body) 10 having passenger windows 12 and an opening 14 which is plugged by a door 16, in this case a center door having door leaves **16*a* and 16*b*. Each door leaf has an upper track mechanism 18, a middle or waist track mechanism 20 and a lower track mechanism 22 associated with it for controlling its compound movement. A one-piece door would, of course, only have one upper, middle and lower track mechanism. In the succeeding discussion, only the track mechanisms associated with the forward center door leaf 16*b* is shown and its operation described. It should be understood, however, that what is true concerning the track mechanisms of the door leaf 16*b* is also true of the track mechanisms associated with the door leaf 16*a***.

The two upper track mechanisms 18 share a common well 24. Likewise, the two lower track mechanisms 22 share a common well 26. The wells are conveniently located near the respective upper and lower edges of the opening 14. The wells are preferably formed as enclosures within the car profile. The middle track mechanism of each door leaf is located partly in its own well 28 and 30. The remaining part of the track mechanism is mounted directly to the door leaf.

As is common with plugged doors, a rubber seal (not shown) is fitted around the door leaf edge to provide a weather seal. In addition, the butt edges (leading edges) 32 and 34 of the door leaves **16*b* and 16*a***, respectively, comprise pressure sensitive edges which will cause the door to open if an obstruction is between them. Such sensitive edges are known. See, for example, U.S. Pat. No. 3,133,167.

In FIG. 2 the relative positions of the elements of the upper (first) track mechanism 18 are shown for a closed and plugged door condition. As noted above, only the upper track mechanism 18 of the door leaf **16*b* is shown. Note that the front surfaces 1*b*′ and 10′** of the door leaf and vehicle body, respectively, are flush in the plugged condition. Note also that in the region of the door leaf vehicle body separation there is located the above noted seal attached either to the door leaf or the vehicle body opening. The seal is not shown, however, for clarity.

The upper track mechanism 18 includes four essential elements, namely, a door support arm 36 (first door support arm); a guide rail 38 (first guide rail); an actuator 40 (first actuator) and a slide member 42 (first slide member). The door support arm 36 is connected at one end to the door leaf **16*b* near its upper edge in a conventional manner. The other end of the arm 36 is pinned to the slide member 42 by a pin 44. The arm 36 is also pinned to an extension 46 of the actuator 40 by a pin 48. The actuator 40 is pinned to the vehicle body 10 by a pin 50. Each of the pins are secured and retained in a conventional manner, and permit relative pivotal motion of the elements with the exception of the guide rail 38 which is fixed at both ends to the vehicle body 10 by end lugs 51 and 52. In addition, the slide member 42 is mounted to guide rail 38 and can slide along the length thereof. Preferably the guide rail 38** is tubular, although other configurations are possible.

The guide rail 38 forms a supply supported beam (i.e., supported at both ends) with a portion of the weight of the door leaf **16*b* being transferred by each support of the guide rail 38 to the vehicle body 10**.

The guide rail 38 must be of sufficient length to permit complete opening of the door leaf **16*b* (FIG. 3). The guide rail 38 is inclined as shown in FIG. 2 to provide the door leaf with the necessary outward motion during the opening cycle. The actuator 40 is a linear actuator which exerts a force F having components $F_P$ and $F_T$. The actuator 40, therefore, is not capable of unpluging the door leaf 16*b* by moving it in the direction transverse (T) to the vehicle wall 10. This function is performed by the middle track mechanism 20 to be discussed below. The purpose of the actuator 40 is to provide the necessary motive force to move the door leaf 16*b* in the direction parallel to the vehicle wall 10. The opening sequence of the door leaf 16*b* is shown in FIGS. 3 and 4**.

According to a preferred embodiment, the support arm 36 is offset at the slide member 42 (FIG. 5) to accommodate the spacing between the actuator 40 and guide rail 38 necessary to a proper operation of the actuator 40.

The middle or waist track mechanism 20 shown in FIGS. 6 and 7 includes seven essential elements, namely, a door support arm 54 (second door support arm); a guide rail 56 (second guide rail); a slide member 58 (second slide member); an actuator 60 (second actuator); an over center lock link 62; a locking bellcrank 64; and a link 66. A stop 68 is preferably provided for the bellcrank 64, and a locking arrangement including a cam switch actuator 70 attached to the actuator 60, and a switch 72 is preferably provided for retaining the middle track mechanism 20 locked in the closed position of the door leaf **16*b*. Actuating the switch 72, opens the circuit (not shown) controlling actuation of the actuator 60. The switch 72** can only be overriden by the operator.

The bellcrank 64 and links 62 and 66 together comprise a transfer linkage means between the actuator 60 and the arm 54.

The middle track mechanism 20 is mounted mostly in the well 28 and easily accessible by a removable panel 74. A panel 76 is also provided for covering most of the door support arm 54. This panel is hinged at 78 to an inside wall of the vehicle body and follows the movement of the arm 54 (see FIG. 7). To accomplish this a torsion spring (not shown) may be provided in assembly with the hinge 78.

The guide rail 56 is mounted to the door leaf **16*b* by mounting lugs 80 (only one of which is shown). The arm 54 is pinned to the slide member 58 by a pin 82, and pinned to a lug 84 by a pin 86, the lug 84 being mounted to the vehicle body. The bellcrank 64 is also pivotably mounted to the vehicle body by a pin 88, and the over center link 62 is pivotably connected to both the arm 54 and the bellcrank 64 by pins 90 and 92, respectively. In this mechanism arrangement part of the door leaf weight is transferred to the vehicle body directly by the arm 54**.

Actuation of the linear actuator 60 produces the relative displacements of the elements as shown in FIG. 7, which in turn cause the door leaf **16*b* to become unplugged, i.e., to move substantially transverse of the vehicle body 10 as the arm 54 is pivoted about its pin 86. Preferably both actuators 40 and 60 are actuated simultaneously so that the compound motion of the door leaf 16*b* is achieved in a continuous fashion, with the actuator 60 producing the transverse displacement and the actuator 40 producing the parallel displacement (FIG. 7 shows in dashed lines the door leaf 16*b* as displaced by the actuator 40**).

Figure 8:
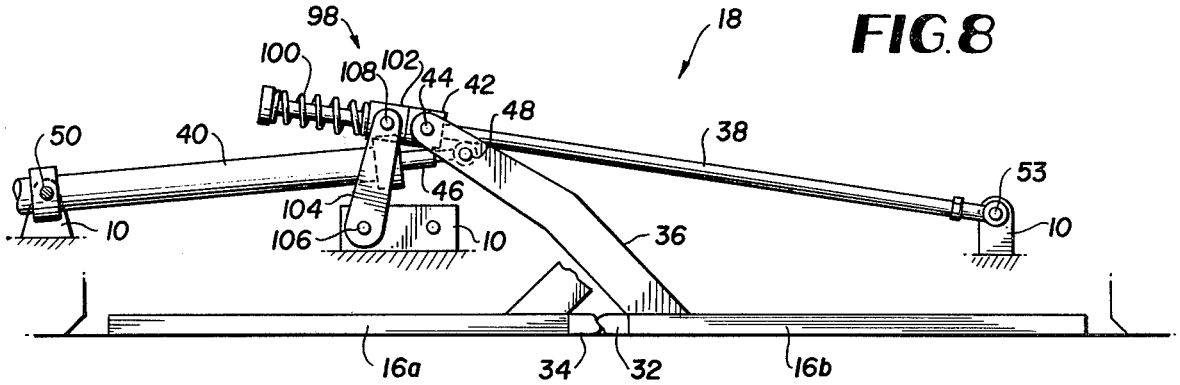
FIGS. 8–10 are schematic views similar to FIG. 2–4 illustrating in addition to the structure of FIGS. 2–4 an extraction device which assists in producing the initial open or unplugged position of the door.

As noted above, the substantially transverse motion of the door leaf **16*b* is produced by the actuator 60, while the parallel motion is produced by the actuator 40. In the embodiment shown in FIGS. 6 and 7 the arm 54 is fully extended when the door leaf 16*b* is unplugged providing a clearance c (FIG. 7). The clearance c can be varied inwardly by the use of an extraction device 98 as part of the upper track mechanism 18 (shown in FIGS. 8–10). The use of the extraction device 98 represents an alternate embodiment of the invention. In this alternate embodiment, the extracting device 98 controls the outward extent (clearance c) of the transverse motion when it is desired to maintain this extent less than that which would be produced by the arm 54. In some situations a greater clearance is desirable, and in these situations the extraction device can be eliminated. However, in those situations where the clearance desired is one close to the car body, then the extraction device 98** is utilized.

When the extraction device 98 is utilized it not only controls the extent of the arm 54, it also assists the transverse motion produced by the actuator 60.

Figure 9:
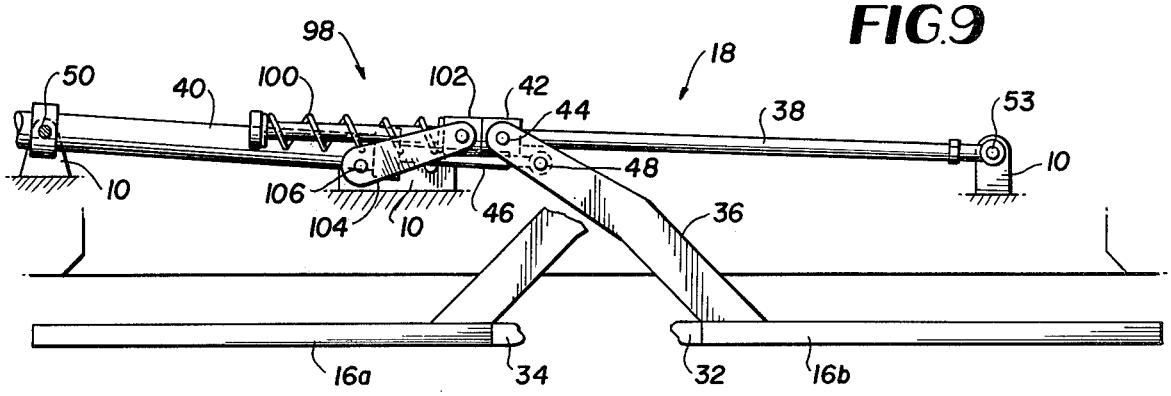
Figure 10:
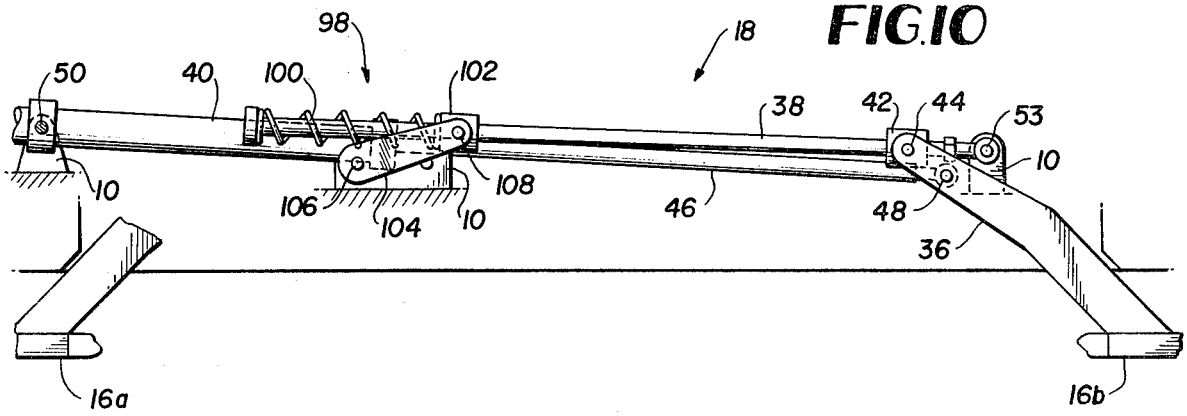

The extraction device includes a compression spring 100, a slidable sleeve 102 and an arm 104 which is pivotably mounted to the vehicle body 10 and to the slidable sleeve 102 by pins 106 and 108, respectively. As shown, the spring 100 and slidable sleeve 102 are concentrically mounted on the guide rail 38. In this embodiment the guide rail 38 is pivotably mounted to the vehicle body 10 by a pin 53. In the position shown in FIG. 8, the spring 100 is maintained in a compressed state by the actuator 40. Upon actuation of the actuators 40 and 60, the stored force in the compression spring 100 moves the door leaf **16*b* outwardly and to the right thereby assisting the action of both actuators (as shown in FIGS. 9 and 10). The arm 104 controls the extent of the outward transverse motion of the door leaf 16*b*. It will be appreciated that in this embodiment, the arm 54 will be pivoted to some intermediate position relative to the postions shown in FIGS. 6 and 7 so that the clearance c will be less than that produced in FIG. 7. The extent of the intermediate position is controlled by the arm 104**.

In this embodiment the weight of the door leaf **16*b* is distributed to the vehicle body 10 primarily by the guide rail 38 and the arm 104**.

The lower track mechanism 22 shown in FIG. 11, includes three essential elements, namely a door support arm 110 (third door support arm); a guide rail 112 (third guide rail); and a slide member 114 (third slide member). The arm 110 is pivotably mounted to the slide member 114 by a pin 116 and the guide rail is mounted to the vehicle body in the well 26 by end lugs 118. Finally, the arm 110 is pivotably connected to the door leaf **16*b* by a hinge 120**. In this way the track mechanism is uncoupled from the door leaf, that is, the track mechanism does not transfer any of the door leaf weight to the vehicle body. The lower track mechanism, serves merely therefore as a guide means for the door leaf.

Note that the transverse motion of the door leaf is not impeded by the lower track mechanism because when the door is closed the arm 110 is oriented substantially horizontally as shown. The door leaf **16*b* can move outwardly as the arm 110 pivots outwardly about its pin 116. During the parallel motion of the door, the door leaf 16*b* moves to the right to the position indicated by dashed lines in FIG. 11**.

The three track mechanism assembly described above shares with the prior art the compound movement feature, i.e., the capability of moving the vehicle door or door leaf transverse to and parallel to the vehicle body. It departs from the prior art in its optimum utilization of space and parts (lower part count); its advantageous distribution of door weight using two track mechanisms; its better guidance using all three track mechanisms; and its utilization of a unique arrangement for assisting and controlling the transverse movement of the door or door leaf.

What is claimed is:

1. In a vehicle having a body with at least one opening for a door, a track mechanism assembly at each opening for supporting the door when closed and during its opening and closing movement, comprising:

(a) a first track mechanism connected to the door and mounted to the vehicle body adjacent generally to the upper part of the opening for thereby distributing part of the door weight to the vehicle body and assisting in guiding the door during its opening and closing movement, said first track mechanism including first actuating means for assisting in opening and closing the door;

(b) a second track mechanism connected to the door and mounted to the vehicle body adjacent generally to the middle part of the opening for thereby distributing the remaining part of the door weight to the vehicle body and assisting in guiding the door during its opening and closing movement, said second track mechanism including second actuating means for assisting in opening and closing the door; and (c) a third track mechanism connected to the door and mounted to the vehicle body adjacent generally to the lower part of the opening for thereby assisting in guiding the door during its opening and closing movement.

2. The track mechanism assembly as defined in claim 1, wherein the first actuating means comprises a first actuator mounted at one end to the vehicle body, wherein the first track mechanism further includes: a first door support arm connected at one end to the door; and a first guide rail mounted at both ends to the vehicle body, and wherein the first door support arm engages at its other end with the first guide rail and the first actuator thereby transferring part of the door weight to the vehicle body through the first guide rail.

3. The track mechanism assembly as defined in claim 1, wherein the first track mechanism further includes: a first guide rail mounted at both ends to the vehicle body; a first slide member mounted to the first guide rail for slidable movement thereon; and a first door support arm connected at one end to the door and pivotably mounted at its other end to the first slide member, wherein the first actuating means comprises a first actuator pivotably mounted at one end to the vehicle body and pivotably connected at the other end to the first door support arm, and wherein the first door support arm is slidably displaced on the first guide rail together with the first slide member in response to actuation of the first actuator, producing thereby a displacement of the door relative to the vehicle body which is substantially parallel to the vehicle body.

4. The track mechanism assembly as defined in claim 3, wherein the first door support arm transfers part of the door weight to the vehicle body through the first guide rail.

5. The track mechanism assembly as defined in claim 1, wherein the first track mechanism further includes: a first guide rail pivotably mounted at one end to the vehicle body, and wherein the first actuating means comprises a first actuator mounted at one end to the vehicle body and connected at its other end to the door for producing a displacement of the door relative to the vehicle body which is substantially parallel to the vehicle body, and an extraction device mounted to the vehicle body and connected to the door for producing a displacement of the door relative to the vehicle body which is substantially transverse to the vehicle body.

6. The track mechanism assembly as defined in claim 5, wherein the first track mechanism further includes: a first door support arm connected at one end to the door; wherein the first guide rail is connected at the other end to the extraction device, and wherein the first door support arm engages at its other end with the first guide rail and the first actuator thereby transferring part of the door weight to the vehicle body through the first guide rail and the extraction device.

7. The track mechanism assembly as defined in claim 1, wherein the first track mechanism further includes: a first guide rail pivotably mounted at one end to the vehicle body; a first slide member mounted to the first guide rail for slidable movement thereon; and a first door support arm connected at one end to the door and pivotably mounted at its other end to the first slide member, wherein the first actuating means comprises a first actuator pivotably mounted at one end to the vehicle body and pivotably connected at the other end to the first door support arm, and an extraction device mounted to the vehicle body and connected to the first guide rail to be slidably displaced thereon, and wherein the first door support arm is slidable displaced on the first guide rail together with the first slide member in response to actuation of the first actuator and the extraction device, producing thereby a displacement of the door relative to the vehicle body which is both substantially transverse to and parallel to the vehicle body.

8. The track mechanism assembly as defined in claim 7, wherein the first door support arm transfers part of the door weight to the vehicle body through the first guide rail and the extraction device.

9. The track mechanism assembly as defined in claim 7, wherein the extraction device includes: a spring; a slidable sleeve, both said spring and slidable sleeve being mounted coaxially on the first guide rail, with the slidable sleeve being in engagement with the first slide member when the door is closed and during the initial opening and final closing periods of the door; and a link member pivotably mounted to the vehicle body and to the slidable sleeve, said link member establishing the maximum extent of the substantially transverse displacement of the door relative to the vehicle body.

10. The track mechanism assembly as defined in claim 9, wherein when the door is closed the first actuator maintains the spring in compression, and wherein the stored spring force is applied to the first door support arm to produce the substantially transverse displacement of the door relative to the vehicle body.

11. The track mechanism assembly as defined in claim 1, wherein the second track mechanism further includes a second door support arm mounted at one end to the vehicle body and connected at the other end to the door thereby transferring part of the door weight directly to the vehicle body.

12. The track mechanism assembly as defined in claim 1, wherein the second track mechanism further includes: a second guide rail mounted to the door; a second slide member mounted to the second guide rail for slidable movement thereon; and a second door support arm pivotably connected at one end to the second slide member and pivotably mounted at the other end to the vehicle body, wherein the second actuating means comprises a second actuator mounted to the vehicle body; and transfer linkage means pivotably connected to the second actuator and the second door support arm for transferring linear displacements produced by the second actuator into pivotal displacements of the second door support arm and a displacement of the door which is substantially transverse to the vehicle body.

13. The track mechanism assembly as defined in claim 12, wherein the transfer linkage means comprises: a bellcrank pivotably mounted to the vehicle body; a link pivotably connected to one arm of the bellcrank and pivotably connected to the second actuator; and an over-center link pivotably connected to the other arm of the bellcrank and pivotably connected to the second door support arm.

14. The track mechanism assembly as defined in claim 1, wherein the first actuating means comprises a first actuator mounted at one end to the vehicle body, the first track mechanism further includes: a first door support arm connected at one end to the door; and a first guide rail mounted at both ends to the vehicle body, with the first door support arm engaging at its other end the first guide rail and the first actuator, and the second track mechanism further includes a second door support arm mounted at one end to the vehicle body and connected at the other end to the door, whereby part of the door weight is transferred to the vehicle body through the first guide rail and part of the door weight is transferred to the vehicle body directly by the second door support arm.

15. The track mechanism assembly as defined in claim 1, wherein the first track mechanism further includes: a first guide rail mounted at both ends to the vehicle body; a first slide member mounted to the first guide rail for slidable movement thereon; and a first door support arm connected at one end to the door and pivotably mounted at its other end to the first slide member, the first actuating means comprises a first actuator pivotably mounted at one end to the vehicle body and pivotably connected at the other end to the first door support arm, the second track mechanism further includes: a second guide rail mounted to the door; a second slide member mounted to the second guide rail for slidable movement thereon; and a second door support arm pivotably connected at one end to the second slide member and pivotably mounted at the other end to the vehicle body, and the second actuating means comprises: a second actuator to the vehicle body; and transfer linkage means pivotably connected to the second actuator and the second door support arm, whereby:

(i) the first door support arm is slidable displaced on the first guide rail together with the first slide member in response to actuation of the first actuator, producing thereby a displacement of the door relative to the vehicle body which is substantially parallel to the vehicle body; and (ii) linear displacements produced by the second actuator are transferred into pivotal displacements of the second door support arm and a displacement of the door which is substantially transverse to the vehicle body.

16. The track mechanism assembly as defined in claim 1, wherein the first track mechanism further includes: a first guide rail pivotably mounted at one end to the vehicle body; a first slide member mounted to the first guide rail for slidable movement thereon; and a first door support arm connected at one end to the door and pivotably mounted at its other end to the first slide member, the first actuating means comprises: a first actuator pivotably mounted at one end to the vehicle body and pivotably connected at the other end to the first door support arm; and an extraction device mounted to the vehicle body and connected to the door, the second track mechanism further includes: a second guide rail mounted to the door; a second slide member mounted to the second guide rail for slidable movement thereon; and a second door support arm pivotably connected at one end to the second slide member and pivotably mounted at the other end to the vehicle body, and the second actuating means comprises: a second actuator mounted to the vehicle body; and transfer linkage means pivotably connected to the second actuator and the second door support arm, whereby:

(i) the first door support arm is slidable displaced on the first guide rail together with the first slide member in response to actuation of the first actuator, producing thereby a displacement of the door relative to the vehicle body which is both substantially parallel to and transverse to the vehicle body; and (ii) linear displacements produced by the second actuator are transferred into pivotal displacements of the second door support arm and a displacement of the door which is substantially transverse to the vehicle body.

17. The track mechanism assembly as defined in claim 16, wherein the first guide rail is connected at its other end to the extraction device, and wherein the first door support arm engages at its other end with the first guide rail and the first actuator thereby transferring part of the door weight to the vehicle body through the first guide rail and the extraction device.

18. The track mechanism assembly as defined in claim 1, wherein the third track mechanism includes: a third guide rail mounted at both ends to the vehicle body; a third slide member mounted to the third guide rail for slidable movement thereon; and a third door support arm pivotably connected at one end to the door and at its other end to the third slide member and wherein the two pivotal connections are oriented at right angles to each other.

19. The track mechanism assembly as defined in claim 1, wherein the first track mechanism further includes: a first guide rail mounted at both ends to the vehicle body; a first slide member mounted to the first guide rail for slidable movement thereon; and a first door support arm connected at one end to the door and pivotably mounted at its other end to the first slide member, the first actuating means comprises a first actuator pivotably mounted at one end to the vehicle body and pivotably connected at the other end to the first door support arm, the second track mechanism further includes: a second guide rail mounted to the door; a second slide member mounted to the second guide rail for slidable movement thereon; and a second door support arm pivotably connected at one end to the second slide member and pivotably mounted at the other end to the vehicle body, the second actuating means comprises: a second actuator mounted to the vehicle body; and transfer linkage means pivotably connected to the second actuator and the second door support arm, and the third track mechanism includes: a third guide rail mounted at both ends to the vehicle body; a third slide member mounted to the third guide rail for slidable movement thereon; and a third door support arm pivotably connected at one end to the door and at its other end to the third slide member, with the two pivotal connections being oriented at right angles to each other, whereby:

(i) the first door support arm is slidable displaced on the first guide rail together with the first slide member in response to actuation of the first actuator, producing thereby a displacement of the door relative to the vehicle body which is substantially parallel to the vehicle body; and (ii) linear displacements produced by the second actuator are transferred into pivotal displacements of the second door support arm and a displacement of the door which is substantially transverse to the vehicle body.

20. The track mechanism assembly as defined in claim 1, wherein the first track mechanism further includes: a first guide rail pivotably mounted at one end to the vehicle body; a first slide member mounted to the first guide rail for slidable movement thereon; and a first door support arm connected at one end to the door and pivotably mounted at its other end to the first slide member, the first actuating means comprises a first actuator pivotably mounted at one end to the vehicle body and pivotably connected at the other end to the first door support arm; and an extraction device mounted to the vehicle body and connected to the door, the second track mechanism further includes: a second guide rail mounted to the door; a second slide member mounted to the second guide rail for slidable movement thereon; and a second door support arm pivotably connected at one end to the second slide member and pivotably mounted at the other end to the vehicle body, the second actuating means comprises: a second actuator mounted to the vehicle body; and transfer linkage means pivotably connected to the second actuator and the second door support arm, and the third track mechanism includes: a third guide rail mounted at both ends to the vehicle body; a third slide member mounted to the third guide rail for slidable movement thereon; and a third door support arm pivotably connected at one end to the door and at its other end to the third slide member, with the two pivotal connections being oriented at right angles to each other, whereby:

(i) the first door support arm is slidable displaced on the first guide rail together with the first slide member in response to actuation of the first actuator, producing thereby a displacement of the door relative to the vehicle body which is substantially parallel to and transverse to the vehicle body; and (ii) linear displacements produced by the second actuator are transferred into pivotal displacements of the second door support arm and a displacement of the door which is substantially transverse to the vehicle body.

21. The track mechanism assembly as defined in claim 20, wherein the first guide rail is connected at its other end to the extraction device, and wherein the first door support arm engages at its other end with the first guide rail and the first actuator thereby transferring part of the door weight to the vehicle body through the first guide rail and the extraction device.

22. In a vehicle having a body with at least one opening for a door, a track mechanism assembly at each opening for supporting the door when closed and during its opening and closing movement, comprising:

(a) a first track mechanism connected to the door and mounted to the vehicle body adjacent generally to the upper part of the opening, said first track mechanism including: a first actuator pivotably mounted at one end to the vehicle body for assisting in opening and closing the door; a first guide rail mounted to the vehicle body for assisting in guiding the door during its opening and closing movement; and a first door support arm connected at one end to the door and engageable at its other end with both the first actuator and the first guide rail thereby transferring part of the door weight to the vehicle body through the first guide rail;

(b) a second track mechanism connected to the door and mounted to the vehicle body adjacent generally to the middle part of the opening, said second track mechanism including: a second actuator mounted to the vehicle body for assisting in opening and closing the door; a second guide rail mounted to the door for assisting in guiding the door during its opening and closing movement; and a second door support arm pivotably mounted to the vehicle body and connected at its two ends to the second actuator and the second guide rail thereby transferring part of the door weight directly to the vehicle body; and (c) a third track mechanism connected to the door and mounted to the vehicle body adjacent generally to the lower part of the opening for thereby assisting in guiding the door during its opening and closing movement.

23. The track mechanism assembly as defined in claim 22, wherein the first track mechanism further includes: a first slide member, to which the first door support arm is pivotably connected, said first slide member being mounted to the first guide rail for slidable movement thereon, and wherein the first door support arm is slidably displaced on the first guide rail together with the first slide member in response to actuation of the first actuator, producing thereby a displacement of the door relative to the vehicle body which is substantially parallel to the vehicle body.

24. The track mechanism assembly as defined in claim 23, wherein the first door support arm transfers part of the door weight to the vehicle body through the first guide rail.

25. The track mechanism assembly as defined in claim 22, wherein the first actuator is connected at its other end to the door for producing a displacement of the door relative to the vehicle body which is substantially parallel to the vehicle body, wherein the first guide rail is pivotably mounted at one end to the vehicle body, and wherein the first track mechanism further includes: an extraction device mounted to the vehicle body and connected to the door for producing a displacement of the door relative to the vehicle body which is substantially transverse to the vehicle body.

26. The track mechanism assembly as defined in claim 25, wherein the first guide rail is connected at its other end to the extraction device, and wherein the first door support arm engages at its other end with the first guide rail and the first actuator thereby transferring part of the door weight to the vehicle body through the first guide rail and the extraction device.

27. The track mechanism assembly as defined in claim 22, wherein the first track mechanism further includes: a first slide member mounted to the first guide rail for slidable movement thereon, and on which the first door support arm is pivotably connected; and an extraction device mounted to the vehicle body and connected to the first guide rail to be slidably displaced thereon, and wherein the first door support arm is slidable displaced on the first guide rail together with the first slide member in response to actuation of the first actuator and the extraction device, producing thereby a displacement of the door relative to the vehicle body which is both substantially transverse to and parallel to the vehicle body.

28. The track mechanism assembly as defined in claim 27, wherein the first door support arm transfers part of the door weight to the vehicle body through the first guide rail and the extraction device.

29. The track mechanism assembly as defined in claim 27, wherein the extraction device includes: a spring; a slidable sleeve, both said spring and slidable sleeve being mounted coaxially on the first guide rail, with the slidable sleeve being in engagement with the first slide member when the door is closed and during the initial opening and final closing periods of the door; and a link member pivotably mounted to the vehicle body and to the slidable sleeve, said link member establishing the maximum extent of the substantially transverse displacement of the door relative to the vehicle body.

30. The track mechanism assembly as defined in claim 29, wherein when the door is closed the first actuator maintains the spring in compression, and wherein the stored spring force is applied to the first door support arm to produce the substantially transverse displacement of the door relative to the vehicle body.

31. The track mechanism assembly as defined in claim 22, wherein the second track mechanism further includes: transfer linkage means pivotably connected to the second actuator and the second door support arm for transferring linear displacements produced by the second actuator into pivotal displacements of the second door support arm and a displacement of the door which is substantially transverse to the vehicle body.

32. The track mechanism assembly as defined in claim 31, wherein the transfer linkage means comprises: a bellcrank pivotably mounted to the vehicle body; a link pivotably connected to one arm of the bellcrank and pivotably connected to the second actuator; and an over-center link pivotably connected to the other arm of the bellcrank and pivotably connected to the second door support arm.

33. The track mechanism assembly as defined in claim 22, wherein the first track mechanism further includes: a first slide member mounted to the first guide rail for slidable movement thereon, and on which the first door support arm is pivotably connected, and wherein the second track mechanism further includes: a second slide member mounted to the second guide rail for slidable movement thereon, and on which the second door support arm is pivotably connected; and transfer linkage means pivotably connected to the second actuator and the second door support arm, whereby:

(i) the first door support arm is slidable displaced on the first guide rail together with the first slide member in response to actuation of the first actuator, producing thereby a displacement of the door relative to the vehicle body which is substantially parallel to the vehicle body; and (ii) linear displacements produced by the second actuator are transferred into pivotal displacements of the second door support arm and a displacement of the door which is substantially transverse to the vehicle body.

34. The track mechanism assembly as defined in claim 33, wherein the first guide rail is pivotably mounted at one end to the vehicle body, and wherein the first track mechanism further comprises: an extraction device mounted to the vehicle body and connected to the door for producing a displacement of the door relative to the vehicle body which is substantially transverse to the vehicle body.

35. The track mechanism assembly as defined in claim 34, wherein the first guide rail is connected at its other end to the extraction device, and wherein the first door support arm engages at its other end with the first guide rail and the first actuator thereby transferring part of the door weight to the vehicle body through the first guide rail and the extraction device.

36. The track mechanism assembly as defined in claim 22, wherein the third track mechanism includes: a third guide rail mounted at both ends to the vehicle body; a third slide member mounted to the third guide rail for slidable movement thereon; and a third door support arm pivotably connected at one end to the door and at its other end to the third slide member and wherein the two pivotal connections are oriented at right angles to each other.

37. The track mechanism assembly as defined in claim 22, wherein the first track mechanism further includes: a first slide member, to which the first door support arm is pivotably connected, said first slide member being mounted to the first guide rail for slidable movement thereon, wherein the second track mechanism further includes: a second slide member mounted to the second guide rail for slidable movement thereon, and on which the second door support arm is pivotably connected; and transfer linkage means pivotably connected to the second actuator and the second door support arm, and wherein the third track mechanism includes: a third guide rail mounted at both ends to the vehicle body; a third slide member mounted to the third guide rail for slidable movement thereon; and a third door support arm pivotably connected at one end to the door and at its other end to the third slide member, with the two pivotal connections being oriented at right angles to each other, whereby:

(i) the first door support arm is slidable displaced on the first guide rail together with the first slide member in response to actuation of the first actuator, producing thereby a displacement of the door relative to the vehicle body which is substantially parallel to the vehicle body; and (ii) linear displacements produced by the second actuator are transferred into pivotal displacements of the second door support arm and a displacement of the door which is substantially transverse to the vehicle body.

38. The track mechanism assembly as defined in claim 37, wherein the first guide rail is pivotably mounted at one end of the vehicle body, and wherein the first track mechanism further comprises: an extraction device mounted to the vehicle body and connected to the door for producing a displacement of the door relative to the vehicle body which is substantially transverse to the vehicle body.

39. The track mechanism assembly as defined in claim 38, wherein the first guide rail is connected at its other end to the extraction device, and wherein the first door support arm engages at its other end with the first guide rail and the first actuator thereby transferring part of the door weight to the vehicle body through the first guide rail and the extraction device.

* * * * *